US007243830B2

(12) United States Patent
Kitamura et al.

(10) Patent No.: US 7,243,830 B2
(45) Date of Patent: Jul. 17, 2007

(54) STAPLE-LEG GUIDE MECHANISM

(75) Inventors: Takuya Kitamura, Tokyo (JP); Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 50 days.

(21) Appl. No.: 10/536,442

(22) PCT Filed: Nov. 14, 2003

(86) PCT No.: PCT/JP03/14537

§ 371 (c)(1),
(2), (4) Date: May 25, 2005

(87) PCT Pub. No.: WO2004/048054

PCT Pub. Date: Jun. 10, 2004

(65) Prior Publication Data

US 2006/0163308 A1 Jul. 27, 2006

(30) Foreign Application Priority Data

Nov. 26, 2002 (JP) ..... 2002-343021

(51) Int. Cl.
*B27F 7/21* (2006.01)
*B25C 5/02* (2006.01)

(52) U.S. Cl. ..... 227/82; 227/131; 227/155

(58) Field of Classification Search ..... 227/131, 227/155, 89, 88, 82, 83, 119, 136
See application file for complete search history.

(56) References Cited

U.S. PATENT DOCUMENTS 5,150,826 A * 9/1992 Logtens ..... 227/88
5,454,503 A * 10/1995 Udagawa et al. ..... 227/82
5,794,833 A * 8/1998 Olle ..... 227/137
6,050,471 A 4/2000 Yagi
6,371,352 B1 * 4/2002 Mochizuki ..... 227/155
6,557,744 B2 * 5/2003 Kitamura ..... 227/119
6,715,654 B2 * 4/2004 Sugihara et al. ..... 227/2
6,871,768 B2 * 3/2005 Adams et al. ..... 227/82
6,896,167 B2 * 5/2005 Haramiishi ..... 227/131
6,899,258 B2 * 5/2005 Haramiishi ..... 227/2
6,974,068 B2 * 12/2005 Mochizuki et al. ..... 227/131
7,014,084 B2 * 3/2006 Mochizuki et al. ..... 227/1
7,021,513 B2 * 4/2006 Olle ..... 227/83

FOREIGN PATENT DOCUMENTS

| | | |
|---|---|---|
| EP | 838315 | 4/1998 |
| JP | 2501487 Y2 | 4/1996 |
| JP | 10-180710 | 7/1998 |
| JP | 7-53904 Y2 | 12/1998 |

* cited by examiner

*Primary Examiner*—Scott A. Smith
(74) *Attorney, Agent, or Firm*—Morgan, Lewis & Bockius LLP

(57) ABSTRACT

A guide piece 19 that enters between both legs 2*b* of a staple 2 is formed integrally on a pusher 16 that pushes a staple 2 as formed into a striking passage 12, an inclined surface 20 that engages with a staple 2 to operatively retreat the pusher is formed on the guide piece 19 to be positioned thereon so as not to engage with the staple 2 until tip ends of staple legs 2*b* penetrate through sheets, and a driver plate 7 and a forming plate 6 are set to operate out of phase relative to each other so that the forming plate 6 begins forming of a non-formed staple 2*a* after staple legs 2*b* struck out have penetrated through the sheets.

6 Claims, 9 Drawing Sheets

STAPLE-LEG GUIDE MECHANISM

TECHNICAL FIELD

The present invention relates to a staple-leg guide mechanism that binds sheets, by sequentially supplying straight non-formed staples charged in a cartridge to a striking part so as to form into a C-shape, supplying the C-shaped staple, into a striking passage, using a driver plate sliding in the striking passage to strike out the staple supplied into the striking passage, toward sheets, and using a clincher mechanism to bend those staple legs penetrating through the sheets, along a back surface of the sheets.

BACKGROUND ART

Cartridge-type staplers for staple binding are known, in which a cartridge accommodating therein a multiplicity of straight non-formed staples is mounted to a magazine of an electrically driven stapler, non-formed staples in the cartridge are sequentially supplied to a striking part formed on a tip end of the cartridge, the non-formed staple is formed just this side of the striking part by a forming plate to be C-shaped, and the formed staple is supplied into a striking passage, in which a driver plate slides, the driver plate strikes out the formed staple from the striking passage so as to penetrate the staple legs through sheets arranged on a lower surface of the cartridge.

The cartridge accommodating therein a multiplicity of staples is formed at a tip end thereof with the striking passage for striking-out of a single leading staple toward the sheets, and the striking passage is formed between a front end surface of the cartridge and a face plate mounted to a front end of the cartridge. The driver plate reciprocated and driven by a motor provided on a body side of the electrically driven stapler enters into the striking passage formed at the front end of the cartridge to strike out a staple arranged in the striking passage, and tip ends of staple legs penetrating through the sheets disposed on a lower surface side of the cartridge are bent by the clincher mechanism.

With conventional, electrically driven staplers, an anvil arranged on a lower surface of a non-formed staple is formed just this side of a striking passage, the anvil and a forming plate form the non-formed staple to make-the same C-shaped, and the C-shaped staple is supplied into the striking passage by a pusher arranged below the anvil. When a non-formed staple is formed by the forming plate to be C-shape, the pusher is retreated to engage with a rear surface side of the staple, which is formed to be made C-shaped, to push the formed staple forward with a spring bias to supply into a groove of a face plate that defines the striking passage. When a staple in the striking passage is struck out by the driver plate, the pusher pushes staple legs from rear surface sides thereof so as to guide the staple legs struck out.

Forming of a non-formed staple is begun by the forming plate and staple legs in the course of forming abut against the pusher whereby the pusher is retreated to engage with a rear surface side of the C-shaped staple so as to push the staple toward the striking passage. When the pusher is retreated, a pushing force that pushes the staple arranged in the striking passage from the rear may disappear, and guiding may not be sufficiently performed in some cases. In the case where the staple legs of the formed staple are large in length, a large penetrating resistance is generated until tip ends of staple legs penetrate through the sheets, after a crown portion is pushed by the driver plate and the tip ends of the staple legs struck out touch a surface of the sheets. When a pushing force from the rear disappears as described above due to a large distance between the driver plate and the tip ends of the staple legs, jam of staple legs is liable to generate. This tendency is remarkable specifically in a stapler, in which a dimension between tip ends of staple legs and the sheets is set to be large.

As described above, as a technique for guiding of staple legs struck out in a stapler, in which a dimension between tip ends of staple legs and sheets is set to be large, it is known that guide grooves for guiding of front and rear surfaces and both right and left side surfaces of a formed staple are formed integrally on a face plate that defines a striking passage, and a staple formed by a forming plate is fed into the guide grooves by a driver plate, and further struck out toward the sheets from the guide grooves by the driver plate (see, for example, JP-Y2-2501487).

In such conventional electrically driven stapler, there is a need for mechanisms such as a spring that supports the face plate vertically movably and biases the face plate upward, a supporter for prevention of falling of a staple in the guide grooves formed on the face plate, etc., which make the mechanisms complex and a cause for an increase in cost of the electrically driven stapler. Also, conventional mechanisms are set so that the driver plate strikes out a formed staple at the same time the forming plate forms a non-formed staple to make the same C-shaped, and forming by the forming plate is begun to retreat the pusher before a staple struck out has penetrated completely through the sheet, so that a rear surface of the staple struck out is not supported and an unstable striking state is brought about, which makes a cause for failure, such as jam, etc., in striking.

DISCLOSURE OF THE INVENTION

The present invention has its object to provide a staple-leg guide mechanism for electrically driven staplers, the mechanism being capable of effectively guiding staple legs when a C-shaped staple is struck out from a striking passage by a driver plate, and free from generation of jam of staples, or the like.

In order to solve the problem, a staple-leg guide mechanism, in which a C-shaped staple supplied into a striking passage formed between a front end surface of a staple supply passage and a rear surface of a face plate arranged in front of the staple supply passage is struck out toward sheets from the striking passage by a driver plate, according to the invention has a feature in that a pusher having a pushing portion, by which a C-shaped staple is pushed into the striking passage, is provided on a side of the front end surface of the staple supply passage, a guide piece is formed on the pushing portion of the pusher and continuously projected toward a side of the face plate in a staple striking-out direction through an inclined surface, so as to enter between both legs of a staple in the striking passage, and the inclined surface is formed in a position to engage with a staple when tip ends of staple legs struck out by the driver plate touch the sheets whereby the staple legs are guided by the guide piece.

Also, the invention has a feature in that a staple supply passage that guides a non-formed staple and a striking passage provided on a front end surface of the staple supply passage to permit striking-out of a C-shaped staple, are formed in a cartridge that accommodates therein a multiplicity of non-formed staples and is detachably mounted on a stapler body, and the staple-leg guide mechanism is formed on the front end surface of the staple supply passage of the cartridge.

Also, the invention has a feature in that operation phases of the driver plate and the forming plate are shifted relatively to each other, so that the forming plate starts forming of a non-formed staple after staple legs struck out by the driver plate penetrate through the sheets. Also, the invention has a feature in the provision of a pushing member provided at the back of the guide piece to push the guide piece toward the striking passage.

BRIEF DESCRIPTION OF THE DRAWINGS

FIG. 6(*b*) is a fragmentary, vertical side view showing, in enlarged scale, a state before the staple binding operation is begun;

FIG. 7(*b*) is a fragmentary, vertical side view showing, in enlarged scale, a state, in which the driver plate begins striking of a staple;

FIG. 8(*b*) is a fragmentary, vertical side view showing, in enlarged scale, a state, in which striking is performed until tip ends of staple legs penetrate through the sheets;

FIG. 9(*b*) is a fragmentary, vertical side view showing, in enlarged scale, a state, in which a staple has been completely struck.

Figure 1:
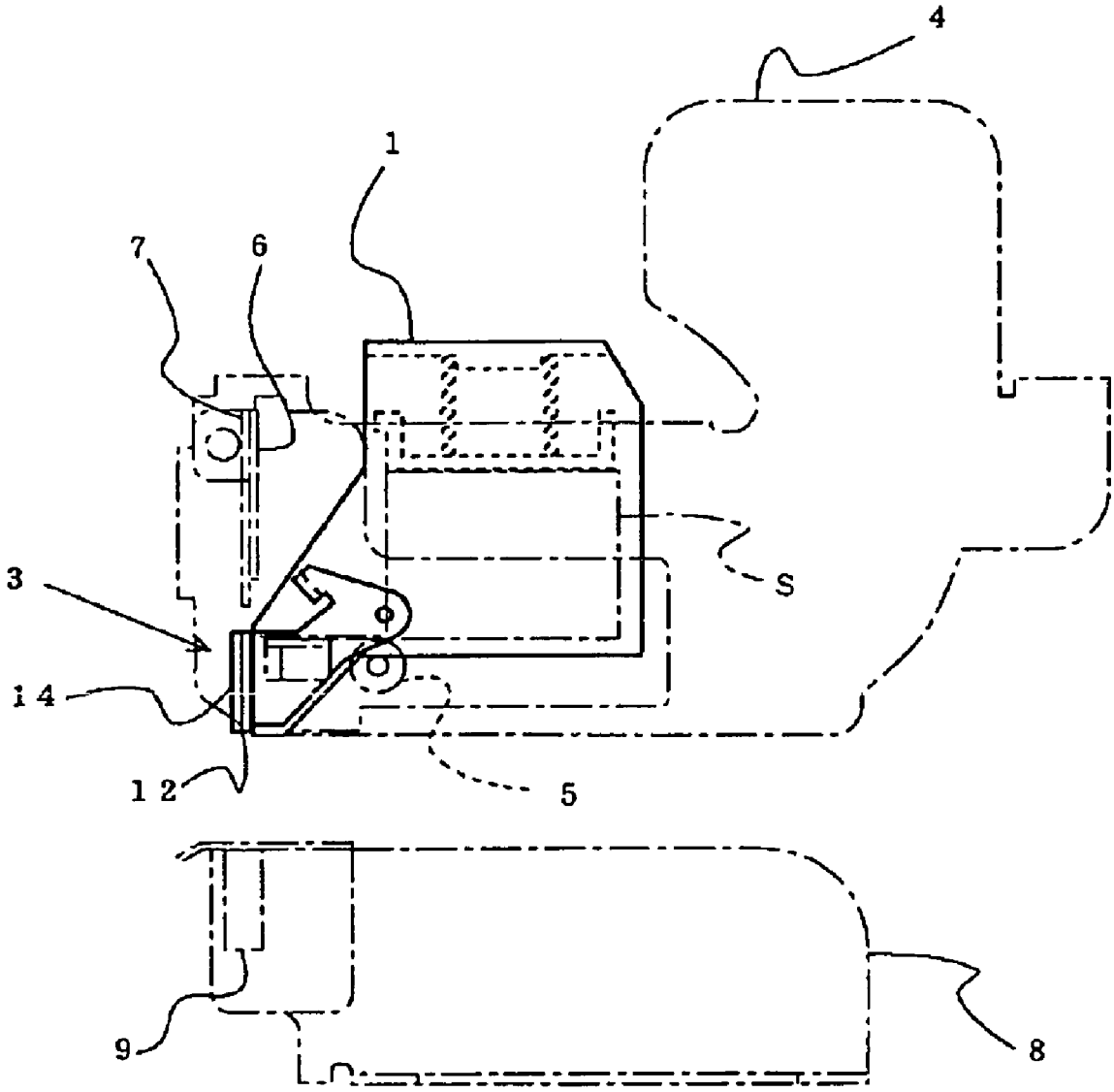
FIG. 1 is a side view showing an outline of an electrically driven stapler, on which a cartridge according to the invention is mounted.

In addition, in the drawings, the reference numeral 1 denotes a cartridge, 2 a staple, 2*a* a non-formed staple, 2*b* legs, 2*c* a crown portion, 3 a striking portion, 6 a forming plate, 7 a driver plate, 11 a staple supply passage, 12 a striking passage, 14 a face plate, 16 a pusher, 17 a pushing surface, 17*a* inclined surfaces, 18 a spring, 19 a guide piece, 20 an inclined surface, 21 a pushing member, 24 a drive shaft, and 15 slots.

BEST MODE FOR CARRYING OUT THE INVENTION

A mode for carrying out the invention will be described by way of an embodiment shown in the drawings. FIG. 1 shows an outline of an electrically driven stapler according to the invention, and the electrically driven stapler according to the embodiment is an electrically driven stapler of equipment built-in type, which is incorporated in an apparatus such as copying machines, printing machines, facsimile, etc. to automatically bind a predetermined number of sheets, which are copied, printed, or received in facsimile, and in which straight staple stocks accommodated in a cartridge are formed into a C-shape just before being struck out, and thereafter a staple formed to have a C-shape is struck out toward sheets.

The electrically driven stapler comprises a cartridge 1 that accommodates therein a multiplicity of straight non-formed staples 2 and has a striking portion 3 formed at a tip end thereof, a supply mechanism 5 mounting thereon the cartridge 1 to supply a non-formed staple 2*a* in the cartridge 1 to the striking portion 3, a striking unit 4 including a forming plate 6 that forms a non-formed staple 2*a* supplied to the striking portion 3 into a C-shape, and a driver plate 7 that strikes out a staple 2 formed into a C-shape from the striking portion 3, and a clincher unit 8 accommodating therein a clincher mechanism 9 arranged below the striking unit 4 to bend staple legs 2*b*, which have been struck out by the driver plate 7 to penetrate through the sheets, along a lower surface of the sheets.

Figure 2:
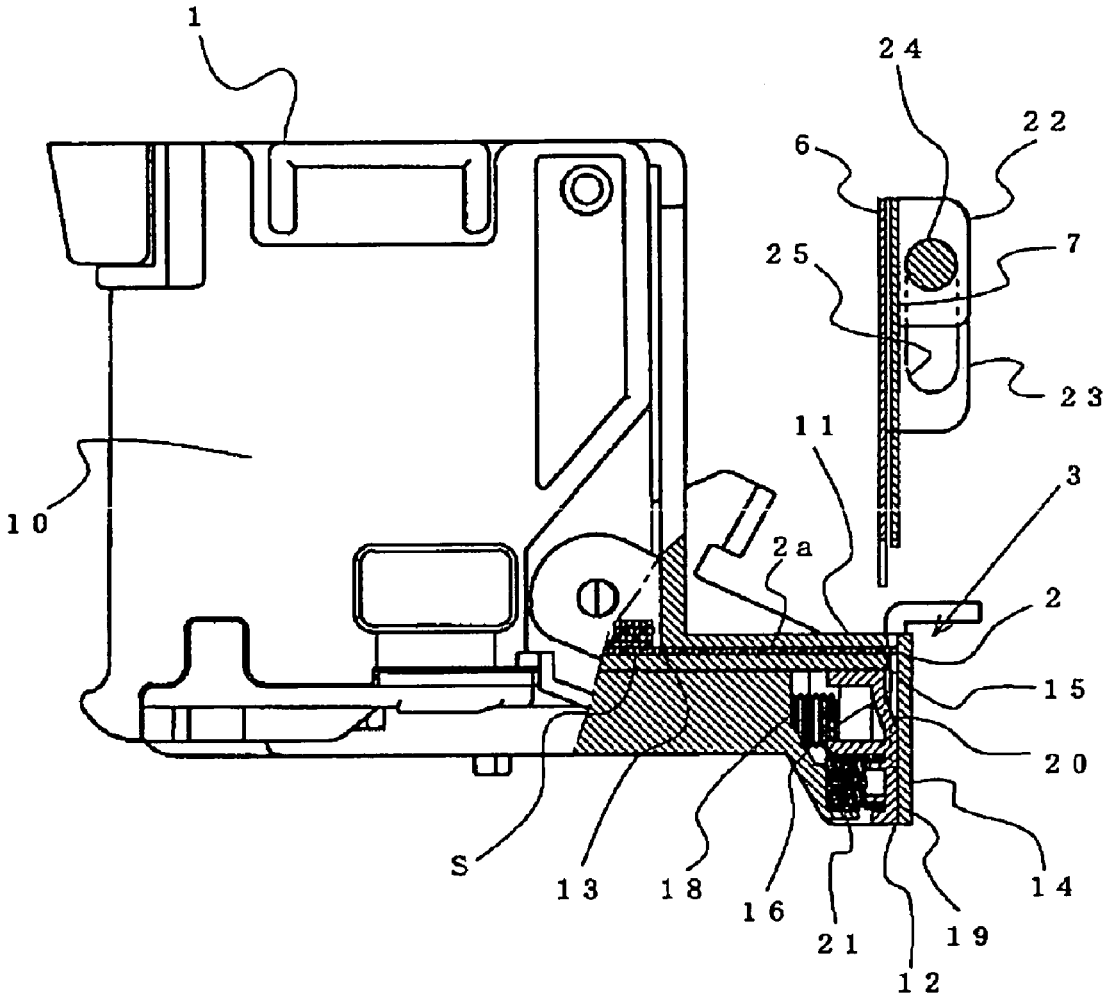
FIG. 2 is a partially fragmentary, vertical side view showing the cartridge mounted on the electrically driven stapler of FIG. 1.
Figure 3:
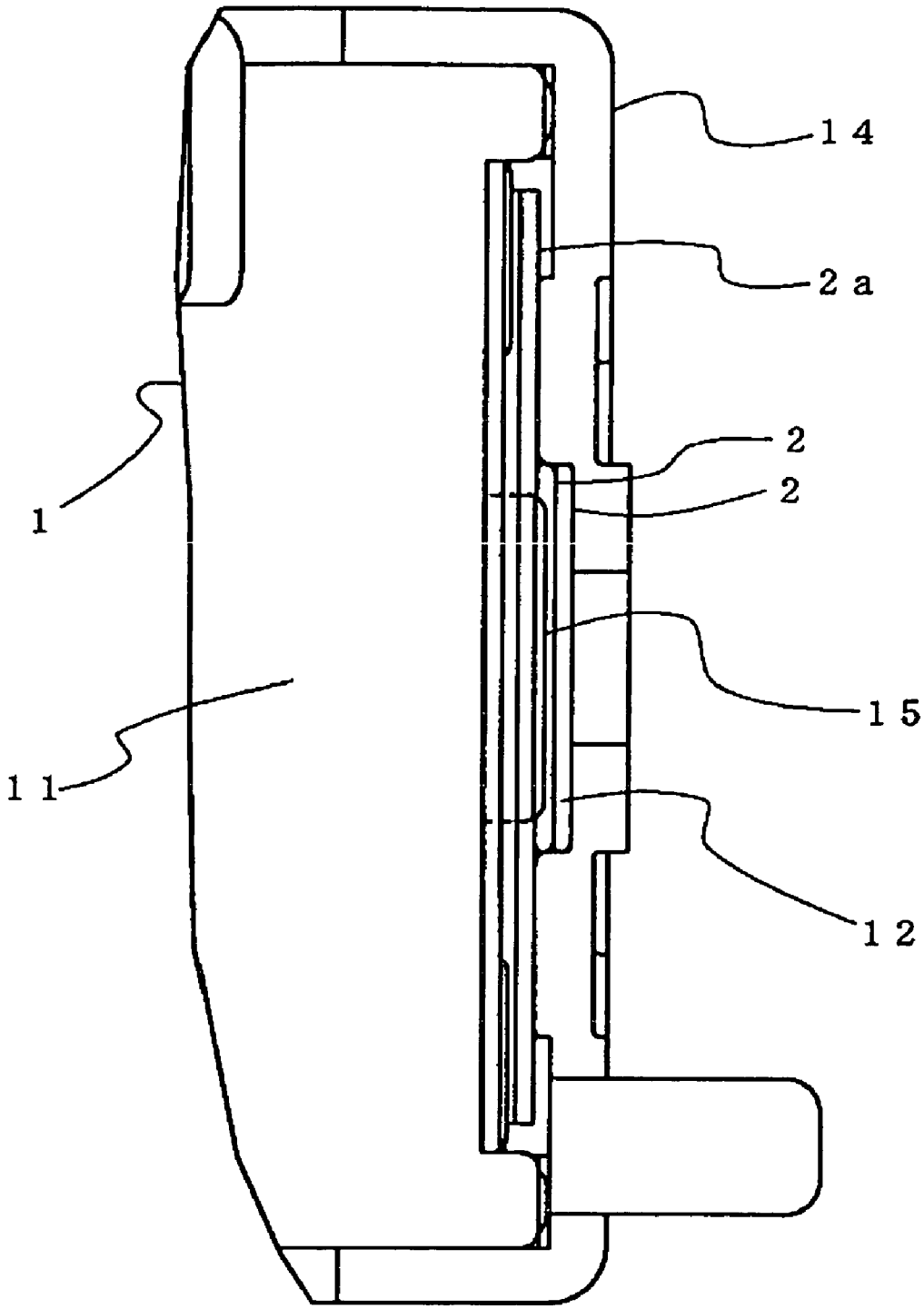
FIG. 3 is a plan view showing a part of the cartridge of FIG. 2.

As shown in FIGS. 2 and 3, the cartridge 1 comprises an accommodation portion 10 that accommodates a sheet staple S, in which a multiplicity of straight non-formed staples 2 are aligned and bonded to be formed flat, a staple supply passage 11, through which a bottom sheet staple S accommodated in the accommodation portion 10 is led and guided to the striking portion 3 formed at a front end of the cartridge 1, and a staple striking passage 12 that forms the striking portion 3 at a front end of the staple supply passage 11. A sheet staple S accommodated in the cartridge 1 abuts against the supply mechanism 5, which is arranged below the cartridge 1, through an opening formed on a lower surface of the accommodation portion, and the supply mechanism 5 sends out a bottom sheet staple S from the accommodation portion 10 through an opening 13 formed on a lower end wall of the accommodation portion 10 to successively supply the same to the striking portion 3.

A face plate 14 is arranged leaving a space from a front end surface of the staple supply passage 11, and the staple striking passage 12 is formed between the front end surface of the staple supply passage 11 and the face plate 14. An anvil 15 is formed at the front end of the staple supply passage 11 to cooperate with the forming plate 6 to form a non-formed straight staple 2*a* into a C-shape, so that a non-formed straight staple 2*a* arranged on the anvil 15 is formed into a C-shaped staple 2 by the action of the forming plate 6.

Figure 5:
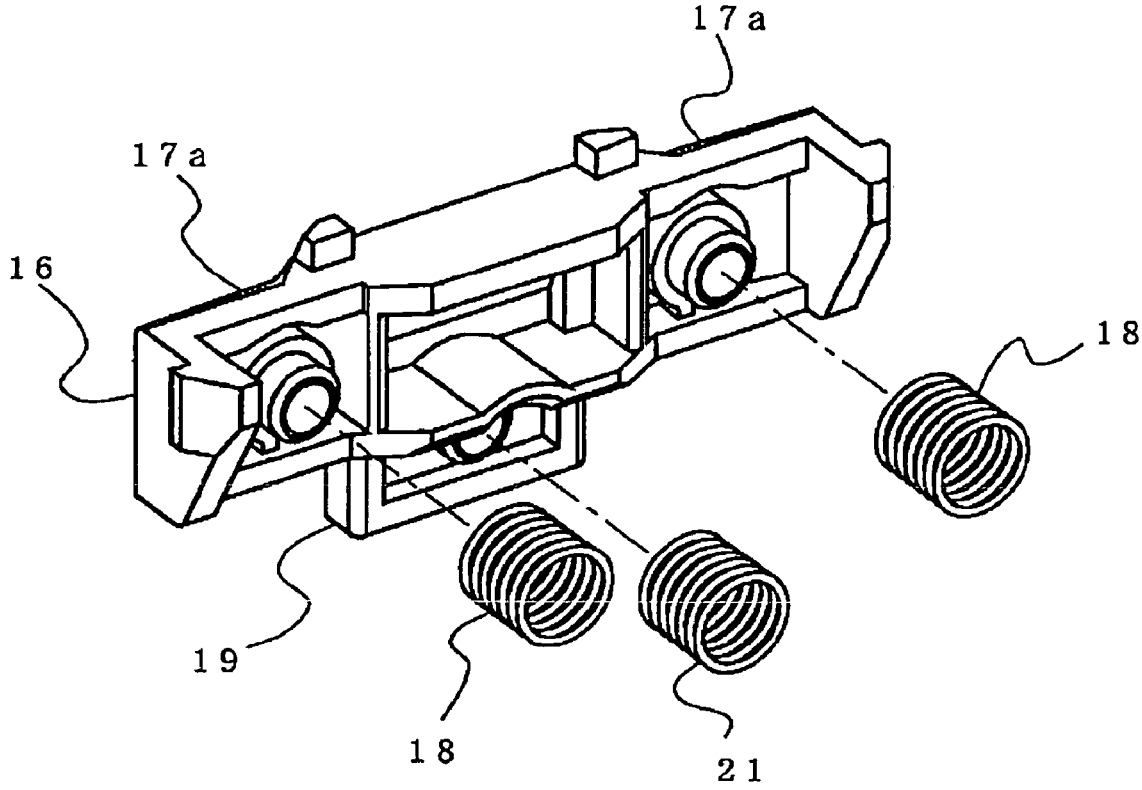
FIG. 5 is a perspective view showing the pusher of FIG. 4 as viewed from the rear.

A pusher 16 is arranged at the front end of the staple supply passage 11 that faces the staple striking passage 12 formed between the front end surface of the staple supply passage 11 and a rear surface of the face plate 14, and the pusher 16 is arranged to be slidable along a direction, in which the formed staple 2 is supplied, and biased by a spring in a direction toward the striking passage 12. A pushing surface 17 is formed at a front surface of the pusher 16 to engage with rear surfaces of the formed staple legs 2*b* to push the staple 2 forward, the pushing surface 17 engages with rear sides of the staple legs 2*b*, which are formed into a C-shape by the forming plate 6, and caused by two springs 18 (see FIG. 5) arranged on both sides rearwardly of the pusher 16 to push the staple 2 forward to supply the same into the striking passage 12 formed in the face plate 14. Inclined surfaces 17*a* are formed on upper end edges of an outer side of the pushing surface 17 of the pusher 16 to engage with staple legs 2*b* in the course of forming by the forming plate 6 to move the pusher 16 rearwardly of the staple 2 being formed.

Figure 4:
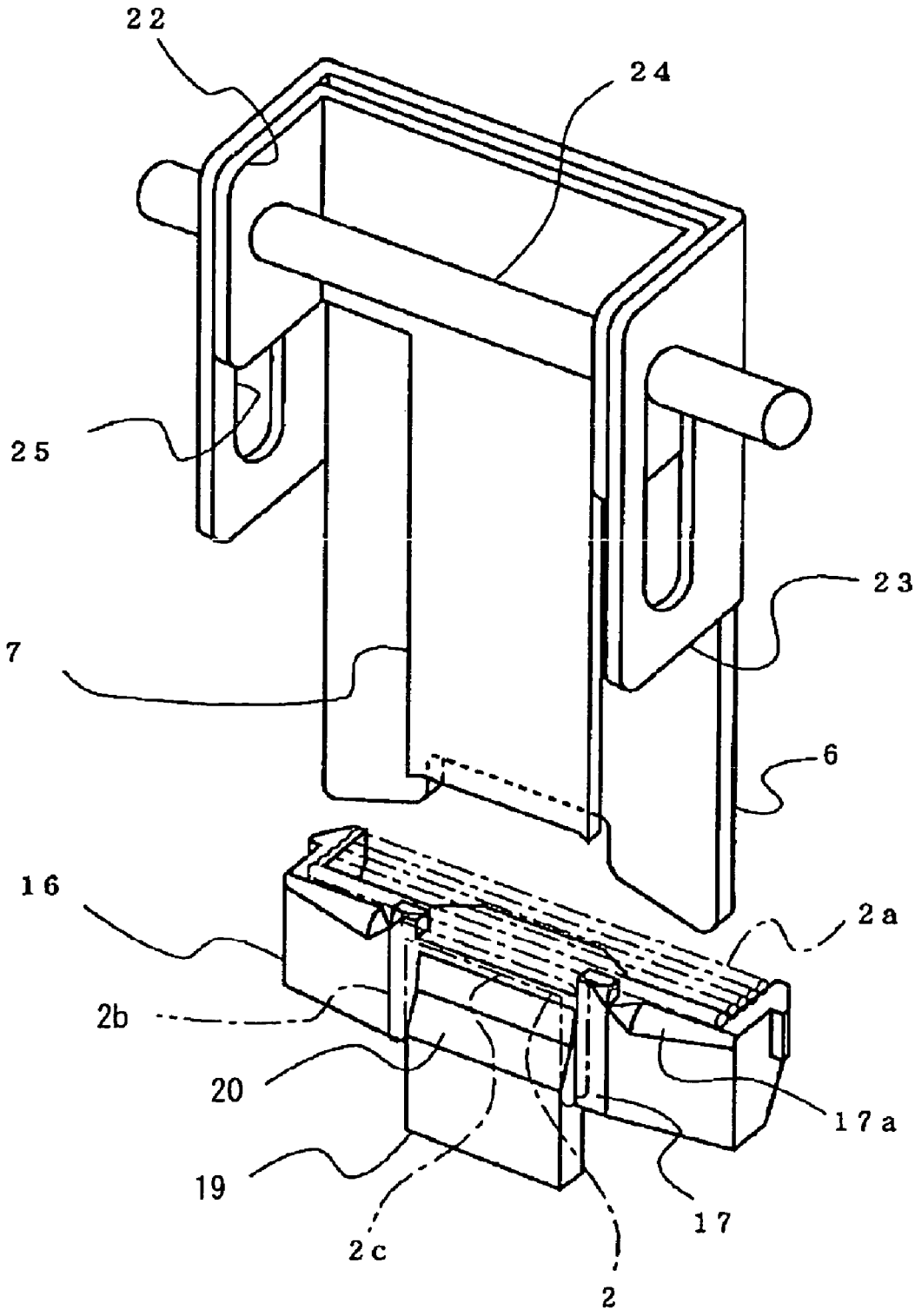
FIG. 4 is a perspective view showing an arrangement of a pusher, a driver plate, and a forming plate, which are formed on the cartridge of FIG. 2.

As shown in FIG. 4, a guide piece 19 is formed integrally on the pusher 16 to be pushed out further forwardly of the pushing surface 17 to be able to enter between staple legs 2*b* of the formed staple 2, and an inclined surface 20 is formed on an upper portion of the guide piece 19. The guide piece 19 is formed to extend to a lower end of the striking passage 12, and sides of the guide piece 19 enter inner side surfaces of staple legs 2*b* of a staple 2 struck out by the driver plate 7 whereby the staple legs 2*b* struck out from the striking passage 12 by the driver plate 7 are guided at the inner side surfaces thereof.

The inclined surface 20 formed on the upper portion of the guide piece 19 engages with a crown portion 2*c* of a staple 2 struck out by the driver plate 7 to bear the crown portion 2*c* of the staple struck out, from an underside thereof to prevent jam of the crown portion 2*c* caused by penetrating resistance. Further, the inclined surface 20 engages with the crown portion 2*c* of the staple 2 struck out by the driver plate 7 to thereby act in a manner to retreat the pusher 16 rearward.

The inclined surface 20 is formed in a position to engage with the crown portion 2*c* of the staple 2 struck out by the driver plate 7 in a position, in which tip ends of the staple legs 2*b* struck out from the striking passage 12 contact with the sheets and arranged on a lower surface side of the striking passage 12, legs 2*a* of the staple 2 are guided at front surfaces and both outer sides thereof by the striking passage 12 until the tip ends of the staple legs 2*b* penetrate through the sheets, and inner side surfaces of staple legs 2*b* are further guided by the guide piece 19, so that stable striking is carried out. A pushing member 21 (see FIG. 5) arranged below a center of a rear surface of the pusher 16 pushes the guide piece 19 of the pusher 16 toward the striking passage 12 to prevent the guide piece 19 from moving rearward to make guiding unstable.

As shown in FIG. 4, a drive shaft 24 is provided to extend through flanges 22, 23 formed on upper portions of the driver plate 7 and the forming plate 6, so that the driver plate 7 and the forming plate 6 are caused to operate vertically through the drive shaft 24. The driver plate 7 operates integrally with the drive shaft 24, and slots 25 fitting the drive shaft 24 loosely thereinto permit the forming plate 6 to operate out of timing with the driver plate 7. That is, setting is made such that as the drive shaft 24 operates, the driver plate 7 operates to strike out the formed staple 2 arranged in the striking passage 12 from the striking passage 12 and the forming plate 6 begins forming of a non-formed staple 2*a* at a point of time when tip ends of the staple 2 penetrate through the sheets.

Also, when striking of the staple 2 is completed and the driver plate 7 and the forming plate 6 return, the driver plate 7 first returns and operates as the drive shaft 24 operates in a direction of return, and the driver plate 7 and the forming plate 6 operate with phase difference so that the forming plate 6 separates from the formed staple 2 after the driver plate 7 retreats from the striking passage 12. In this manner, since timing for return of the driver plate 7 and the forming plate 6 is set, the staple legs 2*b* formed by the forming plate 6 are prevented from spreading, and surely supplied by the pushing operation of the pusher 16 into a groove of the face plate 14 that forms the striking passage 12.

Figure 6A:
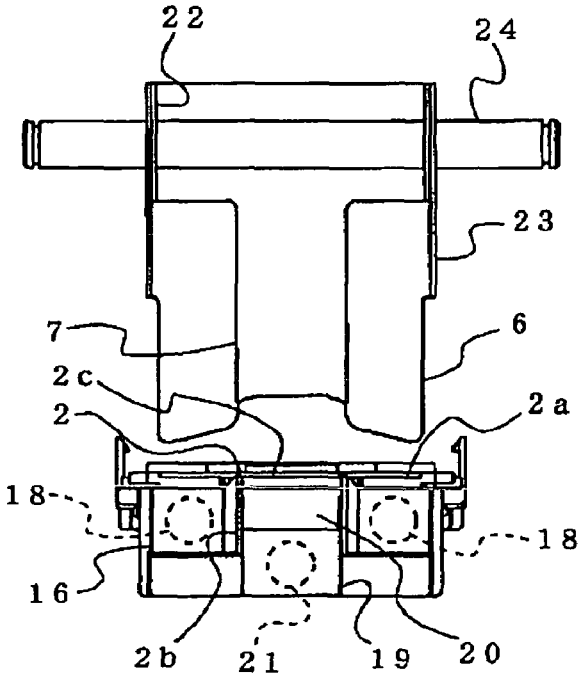
FIG. 6(*a*) is a front view showing a state before a staple binding operation is begun.
Figure 6B:
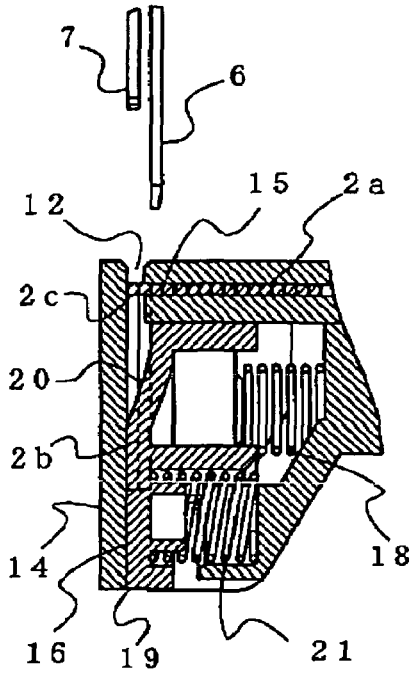

The operation of the embodiment will be described with reference to FIGS. 6(*a*) to 9(*b*). As shown in FIGS. 6(*a*) and 6(*b*), before striking of a staple is begun, both the driver plate 7 and the forming plate 6 stand by in upper initial positions and a leading staple 2 having been formed is arrangedd in the striking passage 12. A second staple 2 succeeding the leading staple 2 is also formed at the time of the previous staple binding operation to be supplied into the groove that forms the striking passage 12. The pusher 16 engages with inner side surfaces of the second staple legs 2*b* and is caused by the pushing action of the springs 18 to push the leading staple 2 into the striking passage 12 through the second staple 2. The guide piece 19 of the pusher 16 enters between the leading staple legs 2*b* to guide the staple legs 2*b* at the inner side surfaces thereof.

Figure 7A:
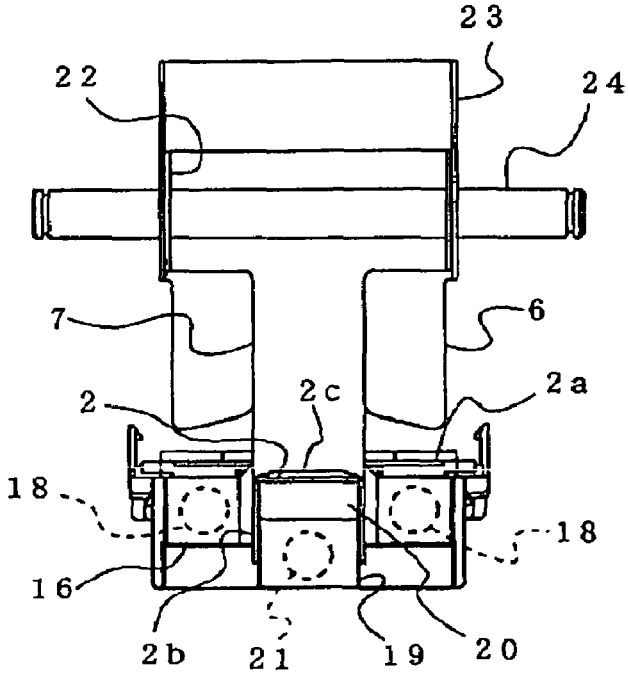
FIG. 7(*a*) is a front view showing a state, in which the driver plate begins striking of a staple.
Figure 7B:
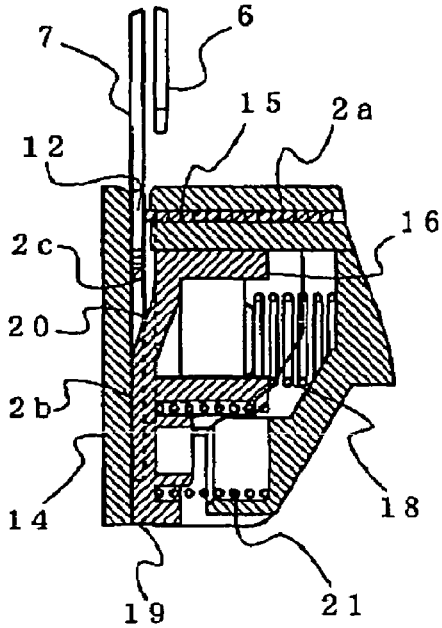

When the drive shaft 24 operates, the driver plate 7 is operated by the drive shaft 24 as shown in FIGS. 7(*a*) and 7(*b*) to enter into the striking passage 12 to engage with the leading staple 2 to release the leading staple 2 from a state of connection with the second staple 2 and to strike out the leading staple in the striking passage 12 toward the sheets. In the meantime, the pushing surface 17 of the pusher 16 is caused by the springs 18 to push the second staple 2 forward, and the leading staple legs 2*b* are pushed forward by the second staple legs 2*b*, so that rear surfaces of the staple legs 2*b* thus struck out are guided. Further, the guide piece 19 formed on the pusher 16 enters between both legs 2*b* of the staple 2 struck out to guide the staple legs 2*b* from inside. Accordingly, the staple legs 2*b* are guided by the face plate 14, the guide piece 19, and the second staple legs 2*b* to be struck.

Figure 8A:
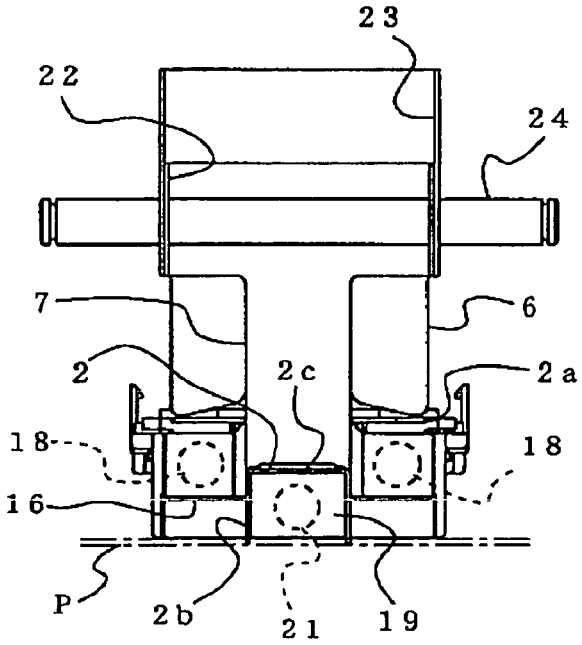
FIG. 8(*a*) is a front view showing a state, in which striking is performed until tip ends of staple legs penetrate through sheets.
Figure 8B:
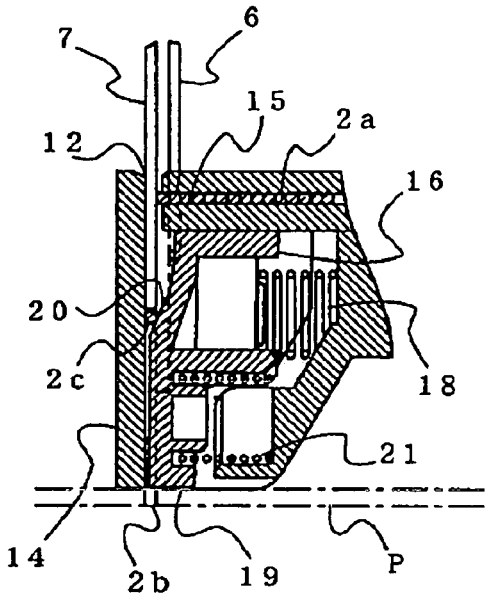

As shown in FIGS. 8(*a*) and 8(*b*), until tip ends of staple legs 2*b* penetrate through sheets P after a point of time when the tip ends of the staple legs 2*b* struck out by the driver plate 7 touch a surface of sheets P, the inclined surface 20 formed on the upper portion of the guide piece 19 engages with a crown portion 2*c* of the staple 2 to support the crown portion 2*c* from under, and the guide piece 19 of the pusher 16 is positioned on inner side surfaces of the staple legs 2*b* of the staple 2 struck out to guide the both legs 2*b* at the inner side surfaces thereof, thus preventing jam from being generated by penetrating resistance when the staple legs 2*b* penetrate through the sheets. When the crown portion 2*c* of the staple 2 struck out is struck below the inclined surface 20, the pusher 16 is retreated to cause the guide piece 19 to leave from between the staple legs 2*b* struck out, and so there is no guidance for the inner side surfaces of the staple legs 2*b*, but at this point of time the tip ends of the staple legs 2*b* have penetrated through the sheets P, so that great penetrating resistance is not generated and buckling or the like is not caused. Since this point of time the forming plate 6 engages with a non-formed staple 2*a* to form the non-formed staple 2*a* into a C-shape.

Figure 9A:
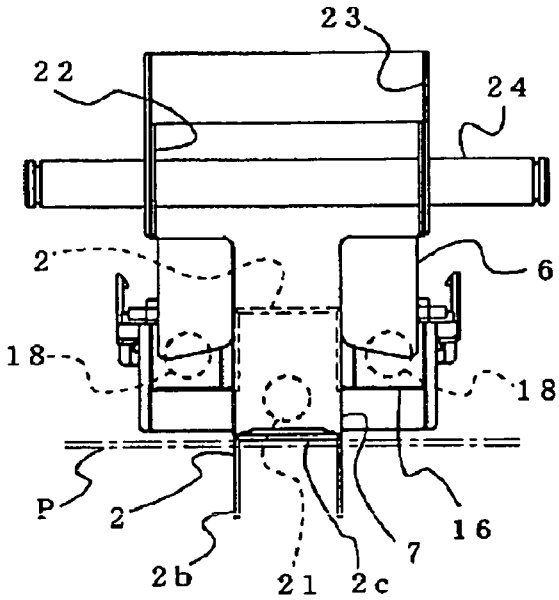
FIG. 9(*a*) is a front view showing a state, in which a staple has been completely struck.
Figure 9B:
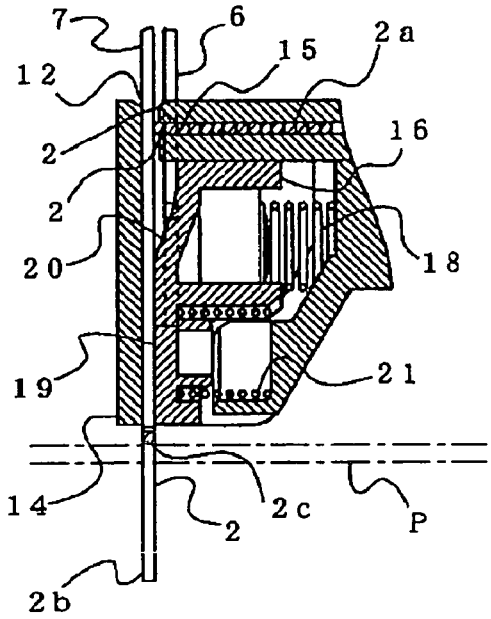

As shown in FIGS. 9(*a*) and 9(*b*), when the driver plate 7 is operated up to a bottom dead point, the crown portion 2*c* of the staple 2 comes into close contact with a surface of sheets P, and the staple legs 2*b* penetrate through the sheets P and are then bent by the clincher mechanism 9 along a back surface of the sheets P, whereby the sheets are bound. While the drive shaft 24 returns to an upper initial position after the termination of staple binding, the driver plate 7 ascends and returns together with the returning operation of the drive shaft 24 and the forming plate 6 begins an ascending and returning operation after the driver plate 7 leaves the striking passage 12. The driver plate 7 and the forming plate 6 operate out of return timing with each other in this manner, whereby when the driver plate 7 leaves the striking passage 12, a staple 2 having been formed into a C-shape by the forming plate 6 is maintained in the formed state by the forming plate 6, in which state the staple is pushed toward the striking passage 12 by the pusher 16 to be supplied into the groove of the striking passage 12.

INDUSTRIAL APPLICABILITY

As described above, the staple-leg guide mechanism according to the invention can prevent generation of jam or the like since a guide piece is projectingly formed on a pushing surface of a pusher with an inclined surface therebetween, the pusher being provided with the pushing surface that pushes a staple, which is formed into a C-shape, into a striking passage, the guide piece is caused to enter between both legs of a staple in the striking passage, and the inclined surface is formed in a position, in which the inclined surface engages with a crown portion of a staple when tip ends of staple legs struck out by a driver plate touch a surface of sheet, so that a crown portion and legs of a staple struck out are surely guided and struck out until the staple arranged in the striking passage is struck out by the driver plate and tip ends of the legs penetrate through the sheet.

Also, since a cartridge that can be detachably mounted to a stapler body and accommodates therein non-formed staples is formed with a staple supply passage, through which non-formed staples are guided, and a striking passage, through which staples formed into a C-shape are struck out to a front end surface of the staple supply passage, and a staple-leg guide mechanism is formed at the front end surface of the staple supply passage, staples suffering jam can be readily removed by dismounting the cartridge from the stapler even in the case where jam or the like is generated on staple legs. Also, staples having long staple legs are stably guided in a vertical direction since a staple is supported from a rear surface side by a succeeding formed staple as in a conventional manner at the time of penetrating through sheet, and further a crown portion thereof is supported from under by the inclined surface.

Also, since a driver plate and a forming plate are set to operate out of phase relative to each other so that the forming plate begins forming of a non-formed staple after staple legs of a staple struck out by the driver plate have penetrated through sheet, the pusher is not retreated by a staple, which is formed by the forming plate, before tip ends of staple legs of a staple struck out by the driver plate touch the sheet, so that a staple struck out is stably guided. Also, at the time of return, the forming plate holds a formed staple until the driver plate retreats from the striking passage, and the driver plate retreats from the striking passage to allow sure supplying into the striking passage by the pusher, so that staple legs of a staple as formed can be prevented from spreading to make supplying into the striking passage impossible.

Further, since a pushing member that pushes a guide piece formed on the pusher toward the striking passage is provided on a rear side of the guide piece, the guide piece surely enters between staple legs of a staple struck out to surely guide the staple legs.

The invention claimed is:

1. A staple-leg guide mechanism, in which a C-shaped staple supplied into a striking passage formed between a front end surface of a staple supply passage and a rear surface of a face plate arranged in front of the staple supply passage is struck out toward sheets from the striking passage by a driver plate, the guide mechanism comprising:

a forming plate operated in a different phase with the driver plate;

a pusher provided on a side of a front end surface of the staple supply passage and having a pushing portion, by which the C-shaped staple is pushed into the striking passage; and a guide piece formed on the pushing portion of the pusher and continuously projected toward a side of the face plate in a staple striking-out direction through an inclined surface, so as to enter between both legs of a staple in the striking passage, wherein the inclined surface is formed in a position to engage with a staple when tip ends of staple legs struck out by the driver plate touch the sheets, so that the staple legs are guided by the guide piece.

2. The staple-leg guide mechanism according to claim 1, wherein the staple supply passage that guides a non-formed staple and the striking passage provided on the front end surface of the staple supply passage for striking-out the C-shaped staple formed in a cartridge that accommodates therein a multiplicity of non-formed staples and is detachably mounted on a stapler body, and the staple-leg guide mechanism is formed on the front end surface of the staple supply passage of the cartridge.

3. The staple-leg guide mechanism according to claim 1, wherein operation phases of the driver plate and the forming plate are shifted relatively to each other, so that the forming plate starts forming of a non-formed staple after staple legs struck out by the driver plate penetrate through the sheets.

4. The staple-leg guide mechanism according to claim 1, further comprising a pushing member provided at the back of the guide piece to push the guide piece toward the striking passage.

5. A cartridge for accommodating a non-formed straight staple therein, comprising:

a staple supply passage;

a striking passage formed between a front end surface of a staple supply passage and a rear surface of a face plate;

a pusher on a side of a front end surface of the staple supply passage;

a pushing portion on the pusher;

a guide piece formed on the pushing portion; and an inclined surface on an upper end edge of an outer side of the guide piece, wherein the guide piece is continuously projected toward the face plate through the inclined surface;

wherein the inclined surface is formed in a position to engage with a staple when tip ends of staple legs struck out by a driver plate of a stapler touch the sheets, so that the staple legs are guided by the guide piece.

6. A non-formed straight staple accommodated in a cartridge, wherein the cartridge comprises:

a staple supply passage;

a striking passage formed between a front end surface of a staple supply passage and a rear surface of a face plate;

a pusher on a side of a front end surface of the staple supply passage;

a pushing portion on the pusher;

a guide piece formed on the pushing portion; and an inclined surface on an upper end edge of an outer side of the guide piece, wherein the guide piece is continuously projected toward the face plate through the inclined surface;

wherein the inclined surface is formed in a position to engage with a staple when tip ends of staple legs struck out by a driver plate of a stapler touch the sheets, so that the staple legs are guided by the guide piece.

* * * * *